US006903309B2

(12) United States Patent
Rhinehart

(10) Patent No.: US 6,903,309 B2
(45) Date of Patent: Jun. 7, 2005

(54) COOKING APPLIANCE HAVING CONCEALED COOKING FEATURE

(75) Inventor: Earl T. Rhinehart, Apison, TN (US)

(73) Assignee: Maytag Corporation, Newton, IA (US)

( * ) Notice: Subject to any disclaimer, the term of this patent is extended or adjusted under 35 U.S.C. 154(b) by 58 days.

(21) Appl. No.: 10/234,313

(22) Filed: Sep. 5, 2002

(65) Prior Publication Data

US 2004/0045952 A1 Mar. 11, 2004

(51) Int. Cl.[7] ..... H05B 3/68

(52) U.S. Cl. ..... 219/452.13; 219/452.11; 219/451.1

(58) Field of Search ..... 219/450.1, 451.1, 219/452.11, 453.11, 453.13, 460.1, 524; 126/299 R, 300, 299 D, 211, 217; 99/337, 340, 422, 423, 424, 426, 427

(56) References Cited

U.S. PATENT DOCUMENTS

| | | | | |
|---|---|---|---|---|
| 2,422,950 A | | 6/1947 | Cash | |
| 3,632,982 A | | 1/1972 | Linger | |
| 3,797,375 A | * | 3/1974 | Cerola | 99/340 |
| 4,042,806 A | * | 8/1977 | McCartney | 219/458.1 |
| 4,431,892 A | * | 2/1984 | White | 219/623 |
| 5,133,248 A | | 7/1992 | Farnsworth et al. | |
| 5,215,074 A | | 6/1993 | Wilson et al. | |
| 5,496,987 A | | 3/1996 | Siccardi et al. | |
| 5,708,255 A | * | 1/1998 | Lamanna et al. | 219/396 |
| 5,884,619 A | * | 3/1999 | Terry | 126/299 D |
| 6,271,504 B1 | | 8/2001 | Barritt | |

FOREIGN PATENT DOCUMENTS

| | | |
|---|---|---|
| FR | 2626964 | 8/1989 |
| GB | 2247747 | 11/1992 |

* cited by examiner

*Primary Examiner*—Sang Paik
(74) *Attorney, Agent, or Firm*—Diederiks & Whitelaw, PLC

(57) ABSTRACT

A cooking appliance shown in the form of a cooktop includes a upper cooking zone and a concealed lower cooking zone. The upper cooking is defined by a pivotally mounted frame portion within which is arranged a plurality of heating elements. Located below the upper cooking zone is a second, lower cooking zone within which are arranged a plurality of lower cooking surfaces. The upper cooking zone is movable betweens a closed position whereupon cooking is performed on the upper cooking surfaces, and an open position whereby access is provided to the lower cooking surfaces. Control of either zone is performed through a plurality of control elements. When the upper cooking zone is in a closed position, the control elements regulate the upper heating surfaces and, when the upper cooking zone is raised to the open position, the control elements are used to control the lower cooking surfaces.

22 Claims, 4 Drawing Sheets

COOKING APPLIANCE HAVING CONCEALED COOKING FEATURE

BACKGROUND OF THE INVENTION

1. Field of the Invention

The present invention pertains to the art of cooking appliances and, more particularly, to a cooking appliance having a concealment feature in the form of a pivotally mounted upper cooking surface arranged above and concealing a lower cooking surface.

2. Discussion of the Prior Art

In the art of cooking appliances, it has become popular to offer cooktops having a variety of different cooking surfaces. Specifically, manufacturers have tried to design cooktops that offer a variety of different cooking surfaces without enlarging the size of the cooktop. In order to avoid enlarging the overall cooktop size, manufacturers have developed designs that either combine various cooking surfaces or offer modular, special purpose cooking cartridges. For instance, various types of cooking surfaces are offered in cartridge form which can be interchanged according to the instantaneous need of a consumer. While this option provides the consumer with a variety of different cooking options without increasing the overall size of the cooktop, the cartridges themselves can be unwieldy. In addition, cartridges require specific storages requirements, e.g. large cabinet space, thus reducing the availability of additional storage in the kitchen or another location which can make the use of such cartridges somewhat inconvenient. However, having the versatility of multiple cooking surfaces is still seen to outweigh the few disadvantages associated with replaceable cartridges.

Other known designs include incorporating different types of cooking surfaces on a single cooktop, examples of which include grills, griddles, and standard burners of various sizes. As with the cartridge option, the overall footprint of the cooktop is not increased, however, the availability of sufficient cooking surfaces is limited. A grill or griddle is not a replacement for a burner. Accordingly, a consumer who wishes to have available multiple burners is restricted by the size of the cooktop. Therefore, regardless of these prior proposed designs, there still exists a need in the art for a cooktop having a variety of different cooking surfaces while maintaining the overall size of the cooktop, such that the cooktop can fit into standard areas and meet the requirements of a residential kitchen.

SUMMARY OF THE INVENTION

The present invention is directed to a cooking appliance having a concealed cooking feature taking the form of a pivoting upper cooking unit which, when raised, reveals a lower cooking unit nestled within the cooking appliance. Most preferably, the cooking appliance includes an outer frame within which is arranged a lower or first cooking zone. The lower cooking zone incorporates at least one lower cooking surface including a first heating element associated therewith. The upper cooking unit includes a second cooking zone and is pivotally connected to the outer frame such that the upper cooking unit is movable between open and closed positions. The upper cooking unit preferably incorporates a plurality of second heating elements carried within the overall second cooking unit.

In addition to the upper and lower cooking zones, the cooking appliance of the present invention includes a plurality of control members for selectively operating each of the various first and second heating elements. In a preferred form of the invention, the control members operate the second cooking unit when the second cooking unit is in the closed position, and operate the first cooking unit when the second cooking unit is in the open position, thereby allowing access to the lower cooking zone.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENTS

Figure 1:
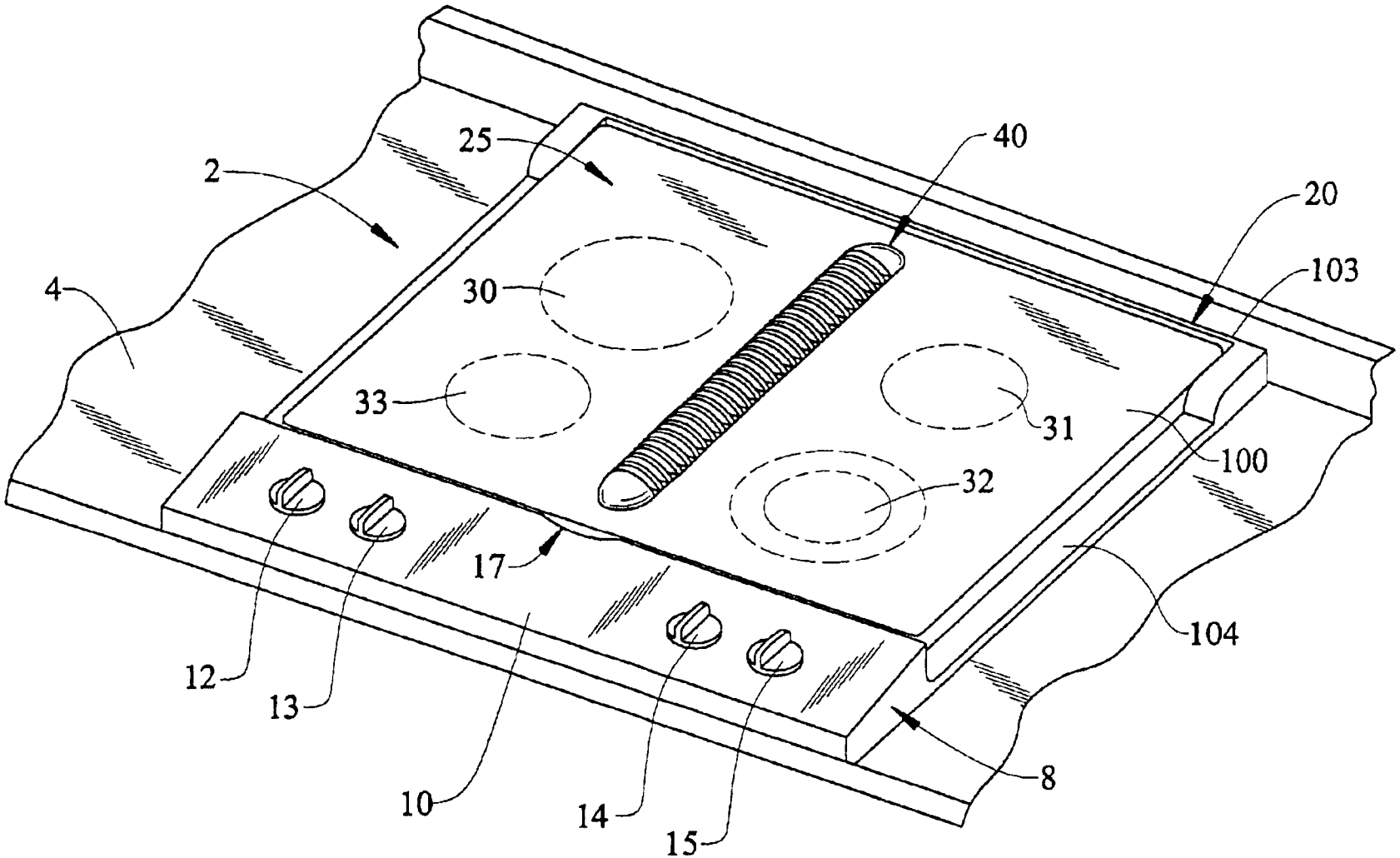
FIG. 1 is a perspective view of a cooking appliance incorporating a concealed cooking feature constructed in accordance with the present invention in a closed or lowered position.
Figure 2:
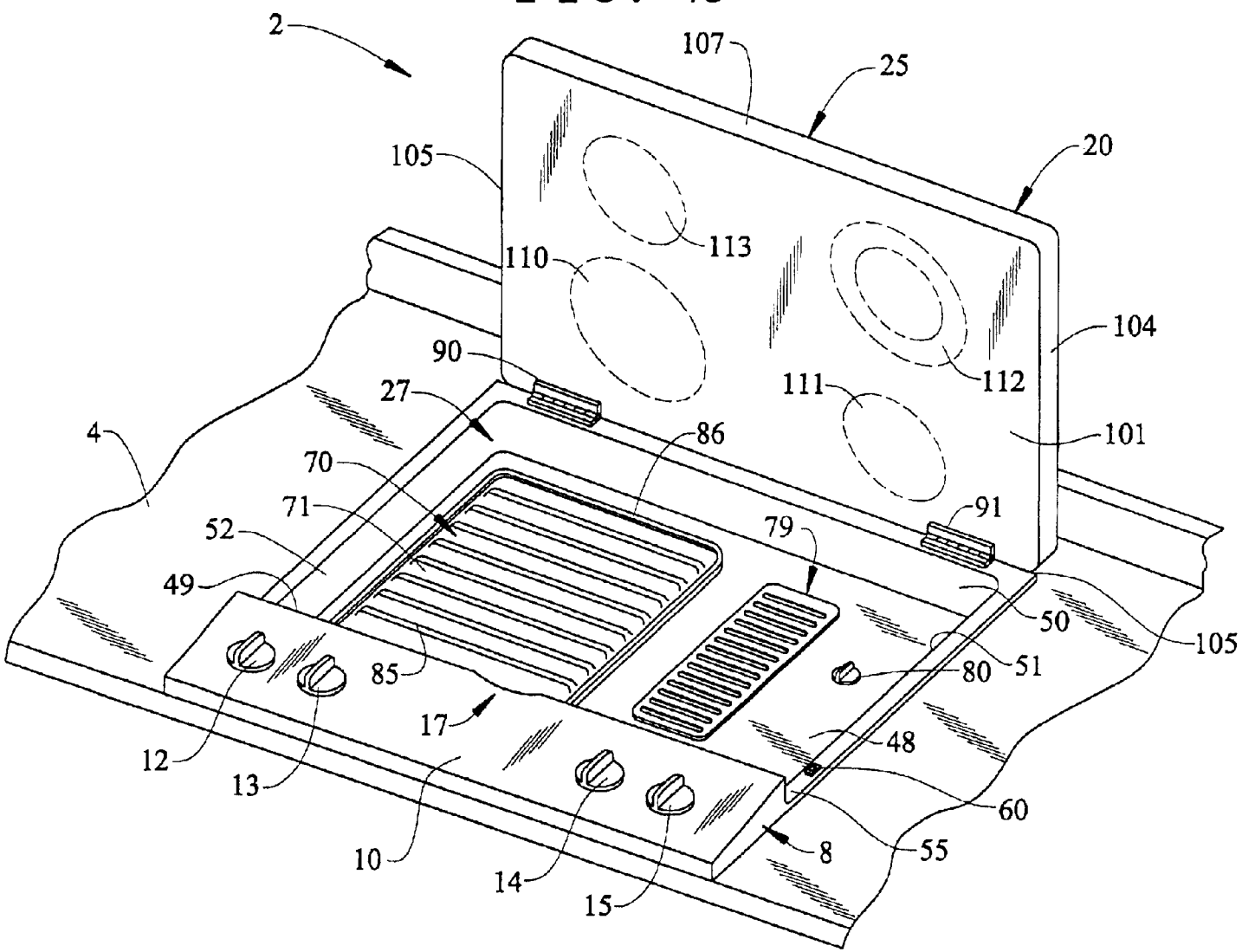
FIG. 2 is a perspective view of the cooking appliance of FIG. 1 in a raised or open position.

With initial reference to FIGS. 1 and 2, a cooking appliance, generally indicated at 2, is shown to take the form of a cooktop mounted upon a kitchen countertop 4. Cooking appliance 2 includes a first frame portion 8 having a front panel 10, and a second frame portion 20 pivotally connected to first frame portion 8. Front panel 10 includes a plurality of control members 12-15 and an elliptical notch 17 as will be detailed more fully below. Second frame portion 20 is movable between a closed or lowered position (FIG. 1) whereby cooking is performed on an upper cooking zone 25, and an open or raised position whereby cooking is performed in a lower cooking zone 27 (FIG. 2). Arranged upon upper cooking zone 25 are a plurality of cooking areas 30-33 and a downdraft fan unit 40. In the embodiment shown, upper cooking zone 25 is depicted as a smooth electric under glass arrangement. However it should be understood that upper cooking zone 25 may take the form of gas under glass, or even conventional surface mounted electric or gas burners, while still remaining within the scope of the present invention.

As best seen in FIG. 2, first frame portion 8 includes a base 48, as well as front, rear and opposing side walls 49–52. Side walls 49–52 terminate, at an uppermost portion thereof, in a peripheral rim 55. Mounted on rim 55 is a switch 60, the operation of which will be discussed further below. Arranged on base 48 is a first lower cooking surface 70 and a lower downdraft fan unit 79 having an associated fan control knob 80. As shown, first cooking surface 70 takes the form of a grill 71. However, it should be understood that first cooking surface 70 may take any conventional form without departing from the scope of the present invention. As will be detailed more fully below, arranged below first cooking surface 70 is an associated first heating element (not shown). In a manner known in the art, grill 71 includes a plurality of raised portions 85 adapted to support an article of food to be cooked, and a peripheral rim 86 adapted to contain drippings associated with a cooking process.

Second frame portion 20 is pivotally connected to peripheral rim 55 through hinges 90, 91. As indicated above, second frame portion 20 is defined by upper cooking zone 25 that includes an upper surface 100, a lower surface 101, as well as front, rear and opposing side members 102–105. Carried within second frame portion 20 are a plurality of second heating elements 110–113. Each of second heating elements 110–113 is associated with a respective one of the plurality of cooking areas 30–33.

Having described the components of cooking appliance 2, a preferred method of operation will now be set forth. In accordance with the invention, cooking appliance 2 can be used to perform a wide variety of cooking operations. For example, with second frame portion 20 in the closed or lowered position of FIG. 1, cooking operations can be performed on one or more of upper cooking areas 30–33, such as with the use of conventional pots, pans, and the like. Depending upon the particular need of a cook, one or more of the plurality of heating areas 30–33 can be utilized, at which time a respective one of control members 12–15, which are shown for exemplary purposes to be in the form of rotary knobs, is operated to activate the respective heating element(s) 110–113.

If a grilling or other cooking operation is desired, lower cooking zone 27 can be accessed by grasping second frame portion 20 at elliptical notch 17 to cause second frame portion 20 to raise through pivoting hinges 90 and 91. As second frame portion 20 is raised, the position of switch 60 is changed, thereby transferring the functions of control members 12–15 from the operation of upper cooking zone 25 to lower cooking zone 27. In one form of the invention, upon exposing lower cooking zone 27, control member 12 is rotated to begin heating a portion of first cooking surface 70. In the most preferred form of the invention, first cooking surface 70 will have multiple associated heating elements, control of which is divided between control knobs 12 and 13. If operation of downdraft fan unit 79 is required during the cooking process, switch 80 is shifted to activate downdraft fan unit 79.

Figure 3:
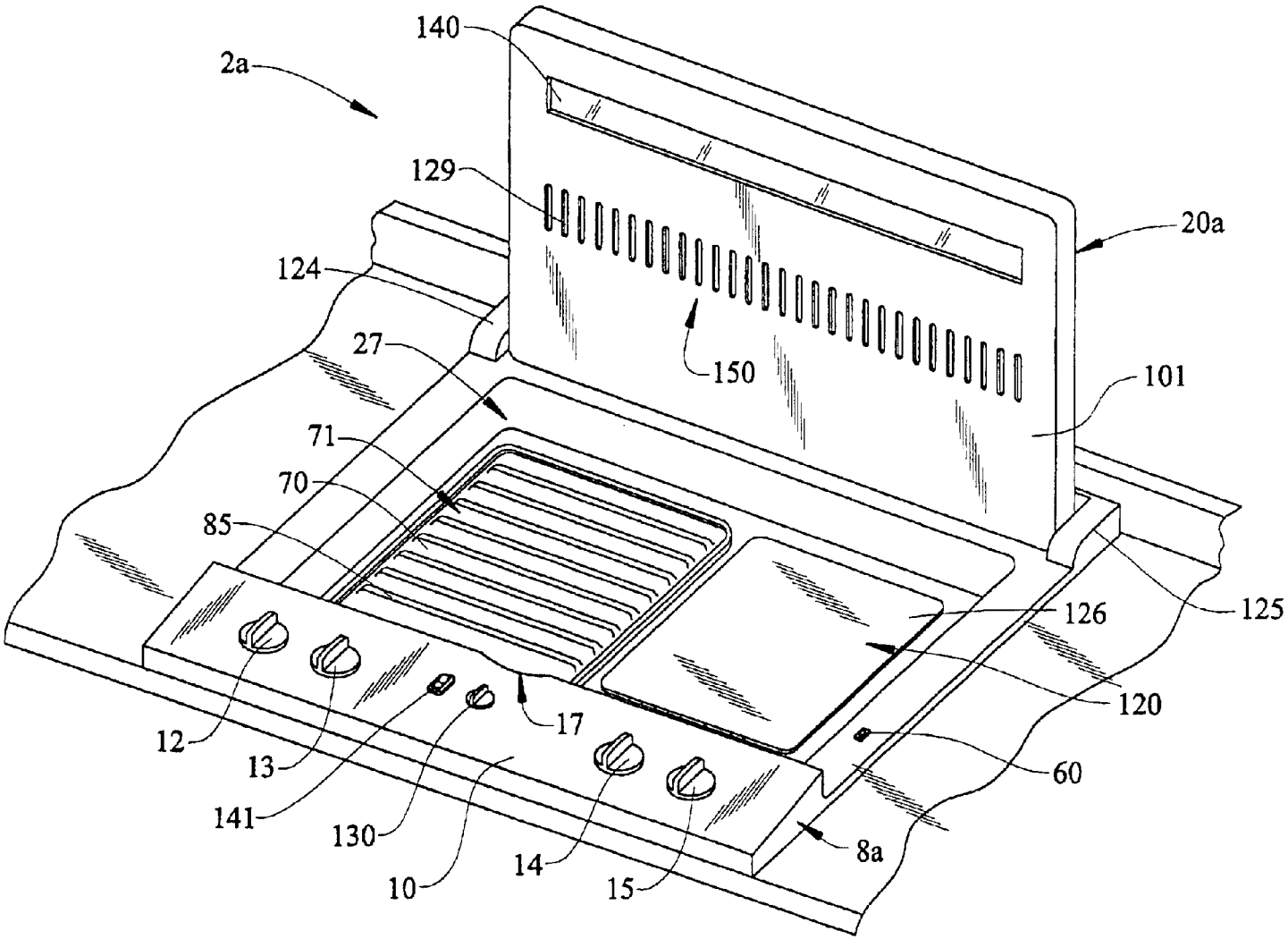
FIG. 3 is a perspective view of an alternative embodiment of the cooking appliance in a raised or open position.
Figure 4:
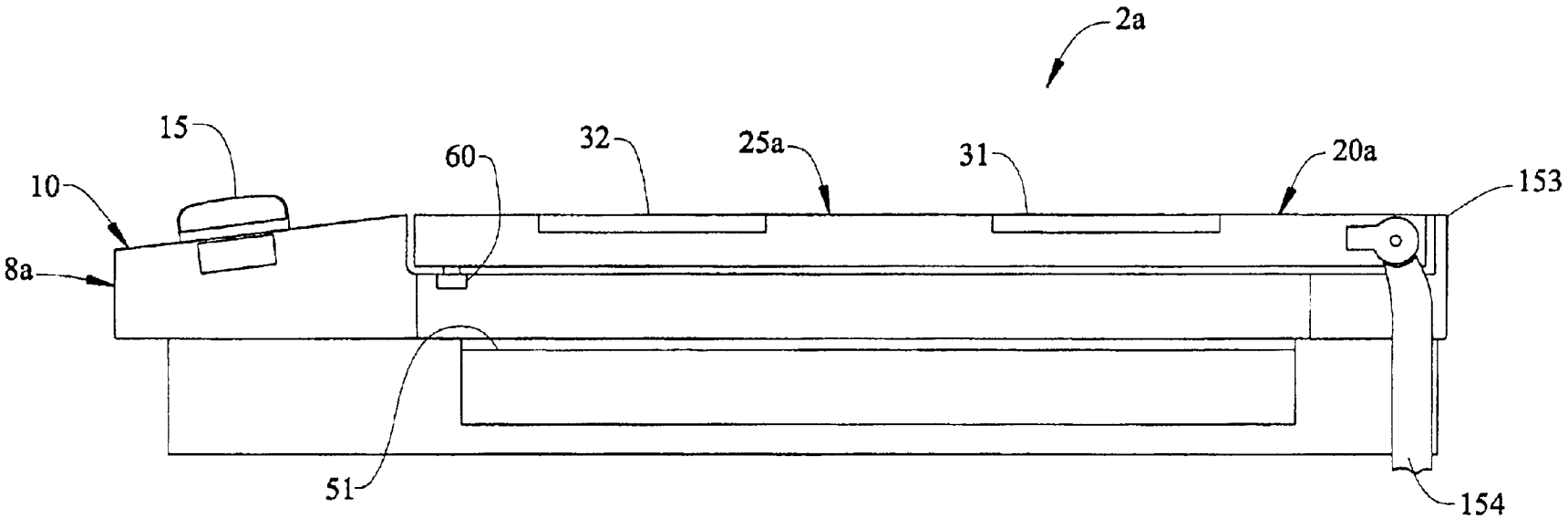
FIG. 4 is a cross-sectional side view of the cooking appliance of FIG. 3.

Another form of the present invention is shown in FIGS. 3 and 4 wherein like reference numbers represent corresponding parts to that of the first embodiment described above. More specifically, a cooking appliance 2*a* incorporating a concealed cooking feature in accordance with the invention includes a second cooking surface 120 arranged adjacent to grill 70 within first cooking zone 27. Additionally, hinges 90 and 91 are replaced by raised portions 124 and 125 on a first frame portion 8*a* to which a second frame portion 20*a* is pivotally mounted. As depicted, second cooking surface 120 takes the form of a griddle 126. However, it should be understood that other conventional cooking surfaces would be acceptable.

In accordance with this embodiment, an updraft fan unit 129 having an associated control 130 and a light 140 including an associated control 141 are carried within second frame portion 20*a*. Updraft fan unit 129 includes an inlet 150, shown generally in the form of a plurality of slits arranged along lower surface 101 of second frame portion 20*a*. To accommodate a flow of air through updraft fan unit 129, a rotating duct 153 is carried within a lower portion of second frame portion 20*a* (see FIG. 4) and an outlet duct 154 is provided in a rear portion of first frame portion 8*a*.

In the embodiment of FIGS. 3 and 4, a user has a choice of using different cooking surfaces arranged within second cooking zone 27. The user can also choose to activate updraft fan unit 129 or light 140 as considered necessary. In a preferred form of the present embodiment, the user can selectively operate different zones on either first cooking surface 70 or second cooking surface 120 through operation of respective control members 12–15. For example, if a user desires to cook pancakes on the entire second cooking surface 120, both control knob 14 and 15 are operated to control the temperature of surface 120. However, if only a portion of surface 120 is needed, either control knob 14 or 15 is operated.

Although described with reference to preferred embodiments of the invention, it should be readily understood that various changes and/or modifications can be made to the invention without departing from the spirit thereof. For instance, it should be readily apparent that the arrangement and type of heating zones can greatly vary in accordance with the invention. In addition, downdraft and/or updraft fan units can also be employed. Although common control members have been advantageously utilized for controlling the various heating elements in each cooking unit, separate controls could also be provided without departing from the invention. In addition, although the invention has been described with specific reference to a cooktop mounted on a kitchen countertop, it should be recognized that the invention could also be employed in other cooking appliance arrangements, such as part of a range. In general, the invention is only intended to be limited by the scope of the following claims.

I claim:

1. A cooktop of a cooking appliance comprising:

a first cooking unit including a first frame section and a first cooking surface, said first cooking surface having an associated first heating element;

a second cooking unit including a second frame pivotally connected to the first frame section and a second cooking surface having a plurality laterally spaced cooking zones, each zone having an associated second heating element carried by the second frame, wherein said second cooking unit is movable between an open position exposing the first cooking unit and a closed position wherein operation of the second cooking surface is enabled; and first and second control members for selectively operating the first and second heating elements, wherein the first control member operates the first cooking unit when the second cooking unit is in the open position and the first control member operates the second cooking unit when the second cooking unit is in the closed position.

2. The cooktop as claimed in claim 1, wherein the first cooking surface defines a grilling unit.

3. The cooktop as claimed in claim 1, further comprising: a downdraft fan unit adapted to remove cooking byproducts generated during a cooking process from the cooktop.

4. The cooktop as claimed in claim 3, wherein the downdraft fan unit is arranged adjacent to the first cooking surface.

5. The cooktop as claimed in claim 1, wherein the second cooking surface constitutes a smooth, ceramic cooking surface.

6. The cooktop as claimed in claim 1, further comprising:

a switch for automatically deactivating the second cooking unit when the second cooking unit is moved to the open position.

7. The cooktop as claimed in claim 1, further comprising: an upper peripheral support rim arranged about the first frame, said peripheral support rim being supported on a countertop.

8. A cooktop of a cooking appliance comprising:

a first cooking unit including a first frame section and a first cooking surface, said first cooking surface having an associated first heating element;

a second cooking unit including a second frame pivotally connected to the first frame section and a second cooking surface having a plurality of cooking zones, each zone having an associated second heating element carried by the second frame, wherein said second cooking unit is movable between an open position exposing the first cooking unit and a closed position wherein operation of the second cooking surface is enabled;

first and second control members for selectively operating the first and second heating elements, wherein the first control member operates the first cooking unit when the second cooking unit is in the open position and the second control member operates the second cooking unit when the second cooking unit is in the closed position; and a third cooking surface arranged adjacent to the first cooking surface as part of the first cooking unit, said third cooking surface having an associated third heating element.

9. The cooktop as claimed in claim 8, wherein the third cooking surface is a griddle unit.

10. A cooktop of a cooking appliance comprising:

a first cooking unit including a first frame section and a first cooking surface, said first cooking surface having an associated first heating element;

a second cooking unit including a second frame pivotally connected to the first frame section and a second cooking surface having a plurality of laterally spaced cooking zones, each zone having an associated second heating element carried by the second frame, wherein said second cooking unit is movable between an open position exposing the first cooking unit and a closed position wherein operation of the second cooking surface is enabled;

first and second control members for selectively operating the first and second heating elements, wherein the first control member operates the first cooking unit when the second cooking unit is in the open position and the second control member operates the second cooking unit when the second cooking unit is in the closed position; and a downdraft fan unit adapted to remove cooking byproducts generated during a cooking process from the cooktop, wherein the downdraft fan unit is mounted on the second cooking surface of the second cooking unit.

11. A cooktop of a cooking appliance comprising:

a first cooking unit including a first frame section and a first cooking surface, said first cooking surface having an associated first heating element:

a second cooking unit including a second frame pivotally connected to the first frame section and a second cooking surface having a plurality of cooking zones, each zone having an associated second heating element carried by the second frame, wherein said second cooking unit is movable between an open position exposing the first cooking unit and a closed position wherein operation of the second cooking surface is enabled;

first and second control members for selectively operating the first and second heating elements, wherein the first control member operates the first cooking unit when the second cooking unit is in the open position and the second control member operates the second cooking unit when the second cooking unit is in the closed position; and an updraft fan unit arranged on a lower surface of the second cooking unit.

12. A cooktop of a cooking appliance comprising:

a first cooking unit including a first frame section and a first cooking surface, said first cooking surface having an associated first heating element;

a second cooking unit including a second frame pivotally connected to the first frame section and a second cooking surface having a plurality of laterally spaced cooking zones, each zone having an associated second heating element carried by the second frame, wherein said second cooking unit is movable between an open position exposing the first cooking unit and a closed position wherein operation of the second cooking surface is enabled;

first and second control members for selectively operating the first and second heating elements, wherein the first control member operates the first cooking unit when the second cooking unit is in the open position and the second control member operates the second cooking unit when the second cooking unit is in the closed position; and a light arranged on a lower surface of the second cooking unit.

13. A cooktop of a cooking appliance comprising:

a first cooking unit including a first frame section and a first cooking surface, said first cooking surface having an associated first heating element;

a second cooking unit including a second frame pivotally connected to the first frame section and a second cooking surface having a plurality of laterally spaced cooking zones, each zone having an associated second heating element carried by the second frame, wherein said second cooking unit is movable between an open position exposing the first cooking unit and a closed position wherein operation of the second cooking surface is enabled; and first and second control members for selectively operating the first and second heating elements, wherein the first control member operates the first cooking unit when the second cooking unit is in the open position and the second control member operates the second cooking unit when the second cooking unit is in the closed position, wherein the second control member is used to operate the first cooking unit when the second cooking surface is moved to the open position.

14. A cooktop of a cooking appliance comprising:

a first cooking unit including a first frame and a first cooking surface, said first cooking surface having an associated first heating element;

a second cooking unit including a second frame pivotally connected to the first frame section and a second cooking surface having a plurality of cooking zones, each zone having an associated second heating element carried by the second frame, wherein said second cooking unit is movable between an open position exposing the first cooking unit and a closed position wherein operation of the second cooking surface is enabled; and a drafting fan unit, provided as part of one of the first and second cooking units, for venting cooking byproducts during operation of the cooktop.

15. The cooktop as claimed in claim 14, wherein the drafting fan unit constitutes a downdraft fan unit.

16. The cooktop as claimed in claim 15, wherein the downdraft fan unit is provided adjacent the first cooking surface.

17. The cooktop as claimed in claim 15, wherein the downdraft fan unit is provided adjacent the second heating element of each of the plurality of cooking zones of the second cooking surface.

18. The cooktop as claimed in claim 14, wherein the drafting fan unit constitutes an updraft fan unit provided as part of the second cooking unit.

19. The cooktop as claimed in claim 18, wherein the updraft fan is operational when the second cooking unit is in the open position, thereby enabling a venting of cooking byproducts during operation of the first cooking unit.

20. The cooktop as claimed in claim 14, further comprising: a third cooking surface arranged adjacent to the first cooking surface as part of the first cooking unit, said third cooking surface having an associated third heating element.

21. The cooktop as claimed in claim 14, further comprising: a light arranged on a lower surface of the second cooking unit.

22. The cooktop as claimed in claim 14, further comprising: a switch for automatically deactivating the second cooking unit when the second cooking unit is moved to the open position.

* * * * *